United States Patent [19]

Eriksson

[11] Patent Number: 4,898,221

[45] Date of Patent: Feb. 6, 1990

[54] METHOD FOR LIMBING, BARKING AND CHIPPING, AND A DEVICE FOR UTILIZATION OF THE METHOD

[76] Inventor: Kjell-Anders Eriksson, Fiskgatan 10, Leksand, Sweden, S-793 00

[21] Appl. No.: 252,370

[22] PCT Filed: Mar. 25, 1987

[86] PCT No.: PCT/SE87/00155

§ 371 Date: Sep. 27, 1988

§ 102(e) Date: Sep. 27, 1988

[87] PCT Pub. No.: WO87/05852

PCT Pub. Date: Oct. 8, 1987

[30] Foreign Application Priority Data

Mar. 27, 1986 [SE] Sweden ..... 8601448

[51] Int. Cl.[4] ..... B27L 3/00; B27L 11/00; B27L 1/00

[52] U.S. Cl. ..... 144/340; 144/2 Z; 144/3 R; 144/208 E; 144/343; 144/335

[58] Field of Search ..... 144/3 D, 2 Z, 335, 338, 144/340, 343, 208 R, 208 E; 241/101.7

[56] References Cited

U.S. PATENT DOCUMENTS

| | | | |
|---|---|---|---|
| 3,308,861 | 3/1967 | Hamilton | 144/3 D |
| 3,533,458 | 10/1970 | McCall | 144/3 D |
| 3,809,134 | 5/1974 | McCabe | 144/3 D |
| 3,955,765 | 5/1976 | Gaitten | 241/101.7 |

FOREIGN PATENT DOCUMENTS

| | | | |
|---|---|---|---|
| 1930687 | 1/1970 | Fed. Rep. of Germany | 144/3 D |

*Primary Examiner*—W. Donald Bray

*Attorney, Agent, or Firm*—Fleit, Jacobson, Cohn, Price, Holman & Stern

[57] ABSTRACT

A method and a mobile unit for barking and/or limbing and chipping as a continuous operation. A log is given a linear displacement movement by means of a feed unit (6) including two in relation to each other displaceable feed rollers in direction towards a chipper (4), and as first step preceding the feed rollers, existing branches are removed by a limbing unit (7) including at least two knife-acting means, displacable in relation to each other in a substantially crosswisely extending plane in relation to the longitudinal and displacement direction for the log, pressed against the peripheral surface of same. During the linear feeding movement of the log, existing branches are sheared or cut off. When performing barking, the feed unit (6) is followed by a rotary barking unit (5) surrounding the log, including a number of barking means with members arranged to take up cutting or frictional contact with the peripheral surface of the log, which by means of centrifugal force during a rotary movement in a plane different from the feeding direction for the log are pressed against the peripheral surface of the log, and by means of a cutting operation remove a layer of bark surrounding the log.

10 Claims, 2 Drawing Sheets

METHOD FOR LIMBING, BARKING AND CHIPPING, AND A DEVICE FOR UTILIZATION OF THE METHOD

CROSS REFERENCE TO RELATED APPLICATION(S)

This U.S. application stems from PCT International Application No. PCT/SE87/00155 filed Mar. 25, 1987.

BACKGROUND OF THE INVENTION

The present invention relates to a method for limbing, barking and chipping logs in a preferably mobile unit, and a device for utilization of the method.

For example, a previously known device is disclosed in U.S. Pat. No. 3,653,417 for removal of limbs and debarking, including a barking unit having a number of pivotally attached barking knives, each one being associated with an hydraulic cylinder by means of which the barking knives can be pressed against a log, and also including a conical member supporting a number of cutters, which when rotated act as a milling cutter, and thus cuts or mills away existing branches from the log. This device is located in an intermediate position between two conveyor belts, which are used to impose a linear movement for the log through the device. A further example of a previously known device is disclosed in SE Patent No. 398 612, intended to remove branches from a log, and chip the removed branches. The log is fed with the larger end portion as a first end portion, and the branches are pressed in direction towards the top of the log and removed, whereafter the branches by means of a conveyor belt are moved to a chipper. It is also proposed that the top of the log is cut off, and moved together with the branches to the chipper. Limbing and barking of the log is performed by means of a rotary limb removing drum, at one end portion having limb cutting and bark removing means peripherally arranged, which by means of a strong rubber band or similar means are pressed against the peripheral portion of the log. These previously known devices are not suitable when, for example, logging in small-tree forests, as when performing thinning, and when relatively small diameter logs are to be transformed into chips.

SUMMARY OF THE INVENTION

The present invention discloses a method for limbing, barking and chipping logs as continously following operations, as well as a mobile unit for utilization of the method, and it is particularly well suited for small diameter logs, as obtained during a thinning operation. Adjustment between manufacture of industrial chippings, having a minimal content of bark, and chippings for energy purposes, having a larger content of bark, is also easily performed, as well as adjustment of the barking capacity to the type of trees being processed, and existing variations caused by the actual time of year when barking is performed. The method according to the present invention can be utilized in a machine having a simple technical design, which results in dependable operation and low manufacturing and maintenance costs.

The method according to the present invention makes it possible to perform barking and/or limbing and chipping as a continous operation, an d is based on the steps that a log means of two displacable feed rollers is given a linear displacement movement in direction towards a chipper, and that at least two knife-like means are pressed against the peripheral surface of the log in a step preceeding the feed rollers, the knife-like means being displacable in relation to each other in a substantially crosswisely extending plane in relation to the longitudinal and displacement direction for the log, and which during the linear feeding movement of the log shear or cut off existing branches, and when performing barking, the feed rollers being followed by a rotary barking unit surrounding the log, including a number of barking means having members arranged to take up contact with the peripheral surface of the log, which by means of centrifugal force during a rotary movement in a plane different from the feeding direction of the log are pressed against the peripheral surface of the log, and by means of a cutting or frictional contact operation remove a layer of bark surrounding the log.

The device of utilization of the method according to the present invention includes a vehicle, a chipper attached to the vehicle, and a feeding device including two displacable feed rollers, arranged to impose a linear feeding movement for a log in direction towards the chipper, and it is mainly characterised in that at least two other displacable limbing units are located before the feed rollers in the feed direction of the log, which during a movement in direction towards each other in a plane different from the longitudinal and feeding direction for the log are arranged to take up a substantially embracing contact with the outer portion of the log, and by means of cutting portions directed against said feeding direction cut off or shear off existing branches during the feed movement in direction towards the chipper. As further characteristic features, a barking unit is arranged in an intermediate position in relation to the feed rollers and the chipper, including a drum-shaped member surrounding the log, carrying a number of barking means, which have members for cutting or frictional contact against the outer peripheral surface of a log, said members being arranged to be pressed against a log by centrifugal force applied against weights arranged by the barking means at a distance from the cutting or frictional contact members.

BRIEF DESCRIPTION OF DRAWINGS

An embodiment of a device of utlization of the method according to the present invention, and certain modifications thereof, will be more fully described below with reference to the accompanying drawings, in which.

DESCRIPTION OF PREFERRED EMBODIMENT

Figure 1:
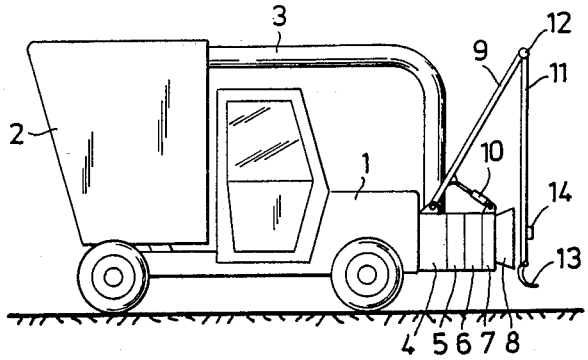
FIG. 1 is a side view of a mobile unit for utilization of the method according to the present invention.
Figure 2:
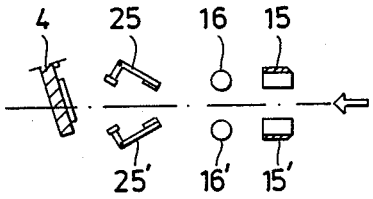
FIG. 2 shows diagrammetically stations in the mobile unit for limbing, feeding, barking and chipping logs.

With reference to FIG. 1, an example of a mobile unit for utilization of the method according to the present invention is shown, including a tractor 1, having a container 2 tiltably attached to the rear portion. A tubular pipe 3 extending above the tractor 1 joins said container 2 with a chipper 4, attached to front end portion of the tractor 1. Said chipper 4 is attached to a barking unit 5, which is preceeded by a feeding unit 6, a limbing unit 7 and an entrance member 8. At the forward end portion of the tractor 1, a device is also attached for lifting the logs to the entrance member 8, comprising a first member 9, pivotally attached at a first end portion against the tractor 1 for movement in the vertical plane when an associated hydraulic piston cylinder 10 is operated, and a second end portion joined to a second member 11 by means of a universal joint 12, whereby said universal joint 12 allows the second member 11 to be pivoted at will in relation to the first member 9 in any desired plane of movement. Adjacent to the free end portion of the second member 11 is an attachment means 13, intended to facilitate seizing of a log, and also a manually operable control member 14, whereby the hydraulic piston cylinder 10 can be operated to raise and lower respectively the first member 9 in relation to the ground plane.

When trees are cut down, a conventional limbing operation is performed a restricted distance along the tree in an upwards direction before the cutting operation is carried out. Such a cut down tree is inserted into the entrance member 8 with the larger end portion as a first end portion. This operation is advantageously performed utilizing previously mentioned device for lifting logs to the entrance member 8, in which case the operator by means of the control member 14 performs a lowering movement of first member 9 to a position in which the attachment means 13 can be secured to the log. Since the second member 11 can be pivoted at will in relation to the first member 9, the log in question can thus be located within an area restricted by the radius of movement for the second member 11 obtainable in relation to the universal joint 12 when the first member 9 is located in a substantially horizontally extended position, i.e. a relatively large area. When the operator has attached the attachment means 13 to the log, the control member 14 is influenced again, whereby the hydraulic piston cylinder 10 performs a movement resulting in a lifting movement of the first member 9 in direction away from the ground, which results in the log being automatically located in a position adjacent to the entrance member 8, from which feeding can be performed.

The larger end portion of the log, from which branches were removed during the cutting operation, is now inserted between two limbing units 15, 15' to two feed rollers 16, 16', which preferably have a forced movement in relation to each other, i.e. a movement in direction to/from each other is performed equal in relation to a point at which the feed rollers 16, 16' are located in an adjacent position to each other. When the log has been inserted between the feed rollers 16, 16', same are pressed against the log by means of a hydraulic piston cylinder or the like, whereafter at least one of the feed rollers 16, 16' is caused to rotate, thereby causing a displacement movement for the log in direction towards the tractor 1.

The limbing units 15, 15' are pressed against the log by means of a substantially linear displacement movement performed in a transversely extending direction to the longitudinal direction of the log. The limbing units 15, 15' are similar to two knives, arranged to cut or shear off existing branches at the log when the log performs a linear displacement movement passed the limbing units 15, 15'. An example of a suitable embodiment will be described in detail later.

From the feed rollers 16, 16', the log is moved to a barking unit 5, which debarks the log, whereafter the log reaches the chipper 4, which is of a conventional type, and includes fan means for producing an air stream by which the chippings can be moved through the tubular pipe 3 to the container 2.

Each of the successively following operations will now be described, with examples of devices used to perform the operations.

Figure 3:
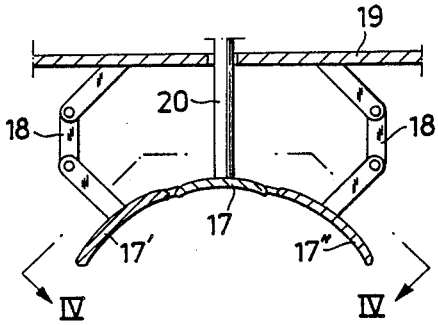
FIG. 3 is a cross-sectional view of a limbing unit according to the invention.
Figure 4:
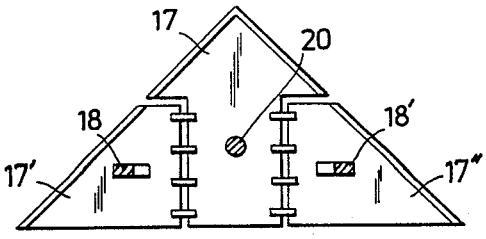
FIG. 4 is a sectional view of the unit shown in FIG. 3, on line IV—IV.
Figure 5:
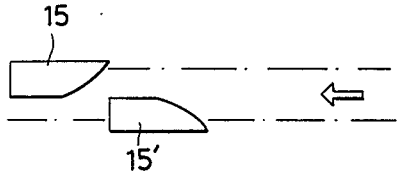
FIG. 5 is a diagrammatical view intended to disclose how two limbing units of the type shown in FIGS. 3 and 4 can be arranged in relation to each other.

The limbing units 15, 15' are, as previously indicated, comparable to two knives, which can only move in a substantially perpendicular plane in relation to the longitudinal direction of the log, and which during the linear displacement movement of the log cut off existing branches. However, in order to accomplish adjustment to the actual log diameter, each limbing unit 15, 15' comprises preferably a number of linked parts, and an example of such an embodiment is shown in FIGS. 3 and 4. According to this embodiment, each limbing unit comprises of three linked knives 17, 17', 17'', the outer knives 17', 17'' being joined by means of a link system 18, 18' to a plateshaped member 19, whereas the centrally located knife 17 is attached to a shaft 20, extending through a hole arranged in the plateshaped member 19. As shown in FIG. 3, the knives 17, 17', 17'' have a curved cross-sectional configuration, and FIG. 4 also shows how the knives 17, 17', 17'' are arranged to form a V-shaped combination with regard to the configuration of the respective cutting edge portions. By displacing the plateshaped member 19 and/or the shaft 20 in direction towards a log located between the limbing units 15, 15', adjustment to the actual diameter of the log is performed by all knives 17, 17', 17'' included in a limbing unit 15, 15', which thus can be brought to maintain a contact position against the outer peripheral portion of a log, and with a continous and successive adjustment to variations in the diameter of the log which may occur during the feeding operation of same in direction towards the chipper 4. It should also be noted, that the knives 17, 17', 17'' in a simple way can be moved in direction away from a log, e.g. when the log is manually inserted, by a movement in direction away from the log of the plateshaped member 19 and the shaft 20. The method in which the edge portions of the knives 17, 17', 17'' are arranged having a V-shaped configuration results in a successive and "soft" cutting operation, and it is also advantageous to arrange the limbing units 15, 15' in a displaced position in relation to each other in the feeding direction, as schematically indicated in FIG. 5. Required movements of the plateshaped member 19 and the shaft 20 are advantageously accomplished by means of hydraulically operated piston cylinders, but other means can obviously be used, for example spring means. Furthermore, the limbing units 15, 15' can also be joined by means of a link system or the like, in order to accomplish simultaneous operation of both limbing units 15, 15'.

Figure 6:
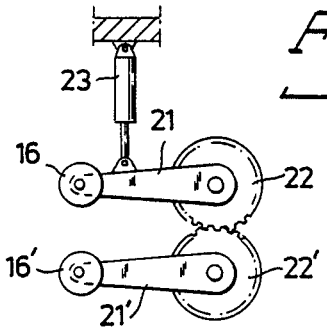
FIG. 6 is a side view of a feeding device.

An example of a feeding unit 6 is schematically shown in FIG. 6, which also shows how the feed rollers 16, 16' can be connected in relation to each other, in order to accomplish a corresponding and simultaneous movement for the feed rollers 16, 16' in a direction to/from each other. Each feed roller 16, 16' is supported by means of pivotally attached supporting link arms 21, 21', each of said link arms 21, 21' being joined to a cog wheel 22, 22' adjacent to the attachment points for the link arms 21, 21'. The cog wheels 22, 22' of an upper and a lower link arm 21, 21' are arranged to intermesh with each other, and as a result, the link arms 21, 21' can perform a corresponding pivoting movement to/from each other, whereby the feed rollers 16, 16' also perform a corresponding movement. The feed rollers 16, 16' are preferably pressed against a centrally located log by means of a hydraulically operated piston cylinder 23. When a log is inserted, the hydraulic piston cylinder 23 is operated to perform a movement, such that the feed rollers 16, 16' are moved away from each other, whereafter the piston cylinder 23 with a substantially constant pressure maintains the feed rollers 16, 16' in a position pressed against a log, while simultaneously at least one feed roller 16, 16' is given a rotary movement, intended to move the log in direction towards the chipper 4. The feed rollers 16, 16' are advantageously provided with a peripheral centrally located surrounding V-shaped groove, intended to center a log in relation to the side portions of the feed rollers 16, 16'. Furthermore, the cog wheels 22, 22' can obviously be replaced by toothed segments or a link system, arranged to cause a similar movement of the feed rollers 16, 16' in direction towards/away from each other.

Figure 7:
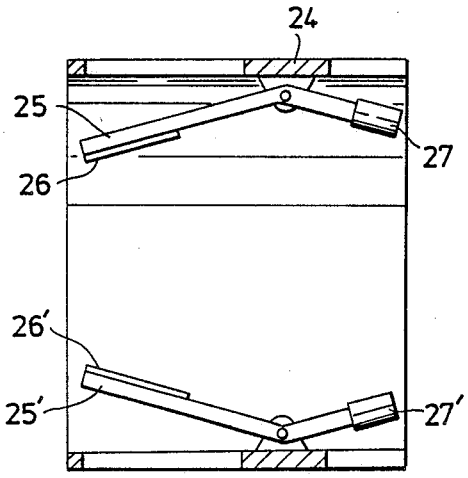
FIG. 7 is a view in longitudinal section of a barking unit according to the invention.

An example of a barking unit 5 is shown in FIG. 7, including a drumshaped member 24, carrying a number of pivotally attached barking means 25, 25'. Said barking means 25, 25' are advantageously arranged with varied angular extension in direction from the point of attachment, e.g. substantially L-shaped, and carry adjacent to a first end portion one or more cutting members 26, 26', and adjacent to a second end portion a counterweight 27, 27'. The possibility for the barking means 25, 25' to perform a pivoting movement in direction towards each other is advantageously restricted, in order to avoid the possibility for the cutting members 26, 26' to contact each other when a log is not located therebetween. The number of barking means 25, 25' can obviously be varied, but four such barking means 25, 25' can be given as a suitable number, preferably having a substantially similar angular orientation in relation to each other. The drumshaped member 24 is arranged having peripherally located openings, which allow removed bark to be expelled, and may advantageously include peripherally located fan means, which produce an air stream causing removed bark to be thrown out from a housing surrounding the drumshaped member 24 and including an outlet opening, preferably directed towards the ground. The drumshaped member 24 is caused to perform a rotary movement, whereby the counterweights 27, 27' by means of centrifugal force press the cutting members 26, 26' against an intermediately inserted log, which during a linear displacement movement past the surrounding and rotary barking means is debarked. The barking depth can be varied as desired by varying the rotary speed of the drumshaped member 24, whereby an increased rotary speed results in that the cutting members 26, 26' perform a cutting operation with a larger number of revolutions within a specific surrounding peripheral surface of the log, but also that the cutting members 26, 26' are pressed with a larger force. A reduction of the rotary speed will obviously result in reversed conditions. The removal capacity during barking can also be varied by a change of the feeding speed for the log, but such a change may result in negative effects during the successively following chipping operation.

In order to facilitate production of chippings to be used for energy purposes, i.e. when a barking operation is not required, the barking unit 5 may advantageously be arranged to facilitate movement to a position, in which a log can pass in a bypassing relationship to the barking unit 5. The barking unit 5 can advantageously be pivotally attached, in order to facilitate a pivoting movement to such a position, but it may obviously also be arranged to perform a substantially linear movement from its operative position.

Adjacent to the cutting member 26, 26' a cutting depth restricting abutment means can be, arranged to restrict removal of material beyond a predetermined barking depth. Such a means can be located adjacent the cutting members 26, 26', to take up contact with the outside surface of the log, and facilitate cutting with a predetermined cutting depth in relation to the point of contact.

The barkings means 25, 25' can easily be removed and replaced by other barking means 25, 25' suited for another type of timber or for another season of the year. The possibility to adapt the cutting ability to existing time of the year is most desirable, since a debarking operation is considerably easier to perform in mild weather than during cold winter weather. The possibility to easily replace the barking means 25, 25' makes it also possible to easily perform a sharpening operation or to replace same, which is also extremely desirable, in order to obtain the best possible removal conditions.

The barking means 25, 25' are also advantageously arranged having a slightly inclined relation to the rotary axis of the drumshaped member 24, whereby the cutting members 26, 26' also obtain a slightly inclined extension, resulting in that said cutting members 26, 26' not only perform a barking operation, but also result in a force applied against the log directed towards the chipper 4, in order to obtain a feeding movement of the final portion of the log in direction towards the chipper 4, when said portion is no longer moved by means of the feed rollers 16, 16'.

The barking means 25, 25' can also be arranged to be influenced by means of an associated spring member to perform a pivoting movement in direction away from each other when the drumshaped member 24 is rotated slower than a predetermined rotary speed, in order to simplify insertion of a log between the cutting members 26, 26'.

According to the invention, a log can thus in a simple and effective fashion be moved to the entrance member 8, the limbing unit 7 being arranged in open position, i.e. with the included two units 15, 15' separated form each other, and also having the feed rollers 16, 16' located in a separated position, in order to facilitate insertion of the log. The drumshaped member 24 is advantageously rotated with a reduced rotary speed. When a first end portion of the log has been inserted between the feed rollers 16, 16', a control means is operated, whereby the limbing units 15, 15' are displaced in direction towards each other to a contact position against the log, and the feed rollers 16, 16' are also pressed against the log. When the log is fed into the drumshaped member 24, the rotary speed of same is increased, if previously reduced, whereby the cutting members 26, 26' of the barking means 25, 25' take up contact with the peripheral surface of the log, thus performing the barking operation. The feed rollers 16, 16' continously feed the log in direction towards the chipper 3, while the limbing unit 7 removes existing branches and the barking unit 5 performs debarking. When the feed rollers 16, 16' take up a closely related position, i.e. when the entire log has been fed through, a valve means or a limit switch is advantageously influenced, in order to automatically return the limbing units 15, 15' to an open position, as well as the feed rollers 16, 16'. A reduction of the rotary speed for the drumshaped member 24 can also simultaneously be accomplished.

The embodiments shown and described can obviously be further modified within the scope of the invention and the following claims, and it is obvious, that the limbing unit 7 in its simplest form may consist of two or more curved knives, arranged to facilitate a radial displacement movement in direction towards a common centre, and necessary contact pressure may for example be obtained from spring members, hydraulically operated piston cylinders or any other suitable pressure means. Furthermore, the barking unit can be designed in a number of fashions, while maintaining influence from centrifugal force to press the barking means against a log. Such influence may for example be arranged to stretch slingshaped chains, wires or similar, which also may be arranged carrying cutting barking tools.

It is obviously also possible to avoid barking, e.g. when producing chippings intended for energy purposes, by disconnecting the rotary drive for the drumshaped member 24, and said drive can be connected again when the log substantially completely has passed the feed rollers 16, 16', provided that the barking means 25, 25' are inclined to cause a feeding movement, thereby giving the final part of the log a continued feeding movement towards the chipper 4.

I claim:

1. A method of barking, limbing and chipping a log which includes the steps of displacing a log linearly towards a chipper by means of feed rollers, shearing branches from the log by means of knife-like means pressed against a peripheral surface of the log at a location preceding the feed rollers and removing bark from the log at a location following the feed rollers by barking means having barking members pressed against the peripheral surface of the log by centrifical force to remove bark from the log by a cutting operation.

2. A mobile unit for barking, limbing and chipping a log said unit comprising a vehicle, a chipper attached to the vehicle, a log feeding device including two displaceable feed rollers for imposing a linear feeding movement on the log in the direction towards the chipper, at least two displaceable limbing units located forwardly of the feed rollers in a feed direction of the log for movement towards one another into a substantially embracing relationship with the log, the limbing units including cutting portions directed oppositely to the feed direction of the log for shearing existing branches from the log during feed movement thereof toward the chipper.

3. A unit according to claim 2 including means for urging the feed rollers toward one another and means for providing complimentary movement of the feed rollers toward and away from one another.

4. A unit according to claim 2 which further includes a barking unit between the feed rollers and the chipper, and barking unit including a drum shaped member for surrounding the log, the drum shaped member carrying a plurality of internal barking members adapted for engaging against the outer surface of the log by centrifical force produced by rotation of the drum shaped member for debarking the log by a cutting action.

5. A unit according to claim 4 wherein the barking members are pivotly attached to the drum shaped member at the respective attachment points and have pairs of arms extending in opposite directions from the respective attachment points, one of said arms being provided with a cutting member and the other of said arms being provided with a counter weight.

6. A unit according to claim 5 wherein the respective arms which carry the cutting members are inclined in relation to the feed direction of the log whereby the cutting members impose a feeding force on the log during the cutting operation for moving the log in a direction toward the chipper.

7. A unit according to claim 3 which includes means for removing the drum shaped member from surrounding relationship to a log whereby a log may bypass the drum shaped member during feed movement toward the chipper.

8. A unit according to claim 2 wherein each limbing unit comprises a plurality of linked knives of curved cross sectional configuration, and a link system for pressing said knives against a a log substantially across the entire cross sectional extension of the knives.

9. A unit according to claim 8 wherein the knives have an overall V-shape cutting configuration and respective means for moving each knife indivually towards and away from a log.

10. A unit according to claim 2 further including an entrance member for the log adjacent the limbing means and a log lifting and feeding means adjacent the entrance member, the lifting and feeding means comprising a pivotal linkage operated by a piston and cylinder assembly, the linkage including a pair of elongated links with a universal joint therebetween and terminating in log attachment means, the configuration of the links being such that the log attachment means may be used to raise a log from ground level to the entrance member.

* * * * *